US011392055B2

(12) United States Patent
Iwasa

(10) Patent No.: US 11,392,055 B2
(45) Date of Patent: Jul. 19, 2022

(54) DEVELOPING CARTRIDGE INCLUDING MOVABLE CAM HAVING FIRST AND SECOND INCLINED SURFACES

(71) Applicant: BROTHER KOGYO KABUSHIKI KAISHA, Nagoya (JP)

(72) Inventor: Go Iwasa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/374,387

(22) Filed: Jul. 13, 2021

(65) Prior Publication Data

US 2021/0356882 A1 Nov. 18, 2021

Related U.S. Application Data

(63) Continuation of application No. PCT/JP2020/005469, filed on Feb. 13, 2020.

(30) Foreign Application Priority Data

Mar. 28, 2019 (JP) ..... JP2019-063301

(51) Int. Cl.
*G03G 15/08* (2006.01)

(52) U.S. Cl.
CPC ..... *G03G 15/0808* (2013.01); *G03G 15/0865* (2013.01)

(58) Field of Classification Search
CPC ..... G03G 15/0808; G03G 15/0865
See application file for complete search history.

(56) References Cited

U.S. PATENT DOCUMENTS 6,385,420 B1 * 5/2002 Morioka ..... G03G 21/1814 399/176
9,367,029 B1 6/2016 Blair et al.
2010/0303508 A1 * 12/2010 Tamura ..... G03G 15/0868 399/258

(Continued)

FOREIGN PATENT DOCUMENTS

JP 2011-059510 A 3/2011
JP 2014-170144 A 9/2014
JP 2018-109655 7/2018

OTHER PUBLICATIONS

International Search Report and Written Opinion issued in PCT/JP2020/005469, dated Mar. 17, 2020.

*Primary Examiner* — Sevan A Aydin
(74) *Attorney, Agent, or Firm* — Merchant & Gould P.C.

(57) ABSTRACT

A developing cartridge includes: a developing roller rotatable about an axis extending in a first direction; a casing; and a first cam provided at an outer surface of one end portion of the casing in a second direction. The first cam is movable in a third direction between a first position and a second position closer to the developing roller than the first position is in the third direction. The first cam has: a first inclined surface for receiving a pressing force in the first direction; and a second inclined surface. A distance between the second inclined surface and the casing in the second direction varies as the second inclined surface extends away from the developing roller in the third direction. The first cam is movable between the first position and the second position in response to application of the pressing force to the first inclined surface.

31 Claims, 11 Drawing Sheets

(56) References Cited

U.S. PATENT DOCUMENTS

| | | | | |
|---|---|---|---|---|
| 2011/0064457 | A1 | 3/2011 | Okabe et al. | |
| 2011/0222903 | A1* | 9/2011 | Kishi | G03G 21/1842 399/111 |
| 2012/0027457 | A1* | 2/2012 | Yamaguchi | G03G 21/1864 399/111 |
| 2017/0248909 | A1* | 8/2017 | Nakamura | G03G 15/0806 |
| 2017/0269544 | A1* | 9/2017 | Itabashi | G03G 21/1676 |
| 2018/0181022 | A1 | 6/2018 | Tabashi | |
| 2019/0302674 | A1* | 10/2019 | Wang | G03G 21/1676 |
| 2019/0302682 | A1* | 10/2019 | Wang | G03G 15/0896 |
| 2020/0103816 | A1* | 4/2020 | Wang | G03G 15/0889 |
| 2020/0103817 | A1* | 4/2020 | Wang | G03G 21/1619 |
| 2020/0103821 | A1* | 4/2020 | Wang | G03G 21/1814 |
| 2020/0285190 | A1* | 9/2020 | Ishizuka | G03G 21/1633 |
| 2021/0341874 | A1* | 11/2021 | Hashimoto | G03G 21/1842 |
| 2021/0349421 | A1* | 11/2021 | Ooka | G03G 21/1647 |
| 2022/0004143 | A1* | 1/2022 | Wang | G03G 21/1671 |

* cited by examiner

DEVELOPING CARTRIDGE INCLUDING MOVABLE CAM HAVING FIRST AND SECOND INCLINED SURFACES

CROSS REFERENCE TO RELATED APPLICATION

This is a by-pass continuation application of International Application No. PCT/JP2020/005469 filed on Feb. 13, 2020 which claims priority from Japanese Patent Application No. 2019-063301 filed Mar. 28, 2019. The entire contents of the earlier applications are incorporated herein by reference.

TECHNICAL FIELD

The present disclosure relates to a developing cartridge.

BACKGROUND

Conventionally, there have been known electro-photographic type image-forming apparatuses such as laser printers and LED printers. Such a conventional image-forming apparatus includes a developing cartridge. The developing cartridge includes a developing roller for supplying developing agent. One of such conventional image-forming apparatuses is disclosed in a prior art. The image-forming apparatus described therein includes a drum cartridge including a photosensitive drum. The developing cartridge is attachable to the drum cartridge. Upon attachment of the developing cartridge to the drum cartridge, the photosensitive drum and the developing roller contact with each other.

SUMMARY

The image-forming apparatus according to the above prior art is switchable between a state where the developing roller and the photosensitive drum are in contact with each other and a state where the developing roller and the photosensitive drum are in separation from each other. In the image-forming apparatus according to the above prior art, components for moving the developing cartridge to separate the developing roller from the photosensitive drum are provided at each side of a drum unit. The components at each side must receive a driving force from a main body of the image-forming apparatus.

In view of the foregoing, it is an object of the present disclosure to provide a developing cartridge capable of providing separation between the developing roller and photosensitive drum by a driving force transmitted from only one side without necessitating application of driving force to both sides.

In order to attain the above and other objects, according to an aspect, the present disclosure provides a developing cartridge including a casing, a developing roller, and a first cam. The casing is configured to accommodate therein developing agent. The developing roller is rotatable about a developing-roller axis extending in a first direction and is contactable with a photosensitive drum. The developing roller has a peripheral surface a portion of which is exposed to an outside of the casing in a second direction and another portion of the peripheral surface opposite the exposed portion in the second direction is positioned inside the casing. The first cam is positioned at an outer surface of one end portion of the casing in the second direction. The first cam is movable in a third direction relative to the casing and the developing roller between a first position and a second position closer to the developing roller than the first position is to the developing roller in the third direction. The first cam has a first inclined surface and a second inclined surface. The first inclined surface is configured to receive a pressing force directing from one end portion of the casing in the first direction toward another end portion of the casing in the first direction. A distance in the second direction between the second inclined surface and the casing varies as the second inclined surface extends away from the developing roller in the third direction. The first cam is movable between the first position and the second position in response to application of the pressing force to the first inclined surface.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the disclosure will be described with reference to accompanying drawings.

In the following description, a direction in which a rotational axis (developing-roller axis) of a developing roller extends will be called as a "first direction." On a peripheral surface of the developing roller, a portion exposed to outside of a casing and a portion accommodated within the casing will be assumed to be arranged side by side in a "second direction." Here, the first direction and the second direction cross each other, preferably orthogonal to each other. Further, a direction crossing both the first and second directions (preferably, orthogonal to the first and second directions) will be called as a "third direction."

<1. Overall Configuration of Image-Forming Apparatus>

Figure 1:
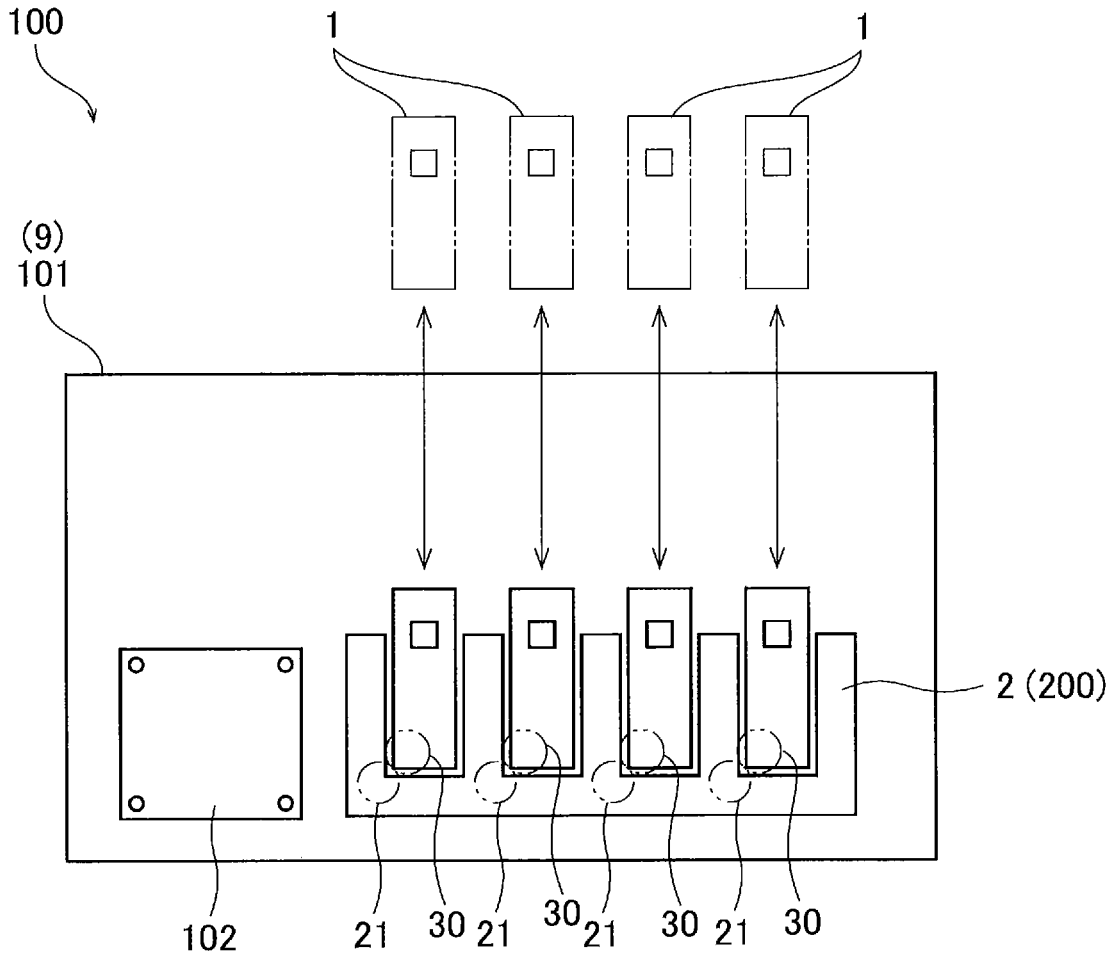
FIG. 1 is a schematic diagram of an image-forming apparatus.

FIG. 1 is a schematic diagram of an image-forming apparatus 100. The image-forming apparatus 100 is an electrophotographic-type printer, such as a laser printer and an LED printer. As illustrated in FIG. 1, the image-forming apparatus 100 includes four developing cartridges 1 according to the present embodiment, a drum cartridge 2, and a main body portion 9.

<1-1. Overall Configuration of Main Body Portion>

Hereinafter, an overall configuration of the main body portion 9 will be described. As illustrated in FIG. 1, the main body portion 9 includes a main-body frame 101, a transfer belt (not illustrated), and a controller 102.

The main-body frame 101 is a generally rectangular parallelepiped and has an internal space therein. The drum cartridge 2 with the developing cartridges 1 attached thereto can be accommodated in the internal space of the main-body frame 101. Further, in the main-body frame 101, four chargers (not illustrated), four light sources (not illustrated), the transfer belt, and the controller 102 are provided.

The main-body frame 101 is a generally rectangular parallelepiped and defines an internal space therein. The drum cartridge 2 with the developing cartridges 1 attached thereto is configured to be accommodated in the internal space of the main-body frame 101. In the main-body frame 101, four chargers (not illustrated), four light sources (not illustrated), the transfer belt, and the controller 102 are also positioned.

The transfer belt is an endless belt for conveying printing sheets. In a state where the drum cartridge 2 to which the developing cartridges 1 are attached is positioned in the internal space of the main-body frame 101, the transfer belt is positioned opposite to developing rollers 30 with respect to photosensitive drums 21. The transfer belt has an outer peripheral surface contactable with outer peripheral surfaces of the respective photosensitive drums 21.

The controller 102 includes a processor such as a CPU, and a main-body memory. The main-body memory is a readable and writable storage medium, such as a Flash ROM and EEPROM. The main-body memory is configured to store computer programs for controlling operations performed in the image-forming apparatus 100. The processor is configured to execute various processing according to the computer programs stored in the main-body memory. That is, the processor is configured to execute various printing processing and other processing associated therewith to be performed in the image-forming apparatus 100.

<1-2. Overall Configurations of Developing Cartridges>

Figure 2:
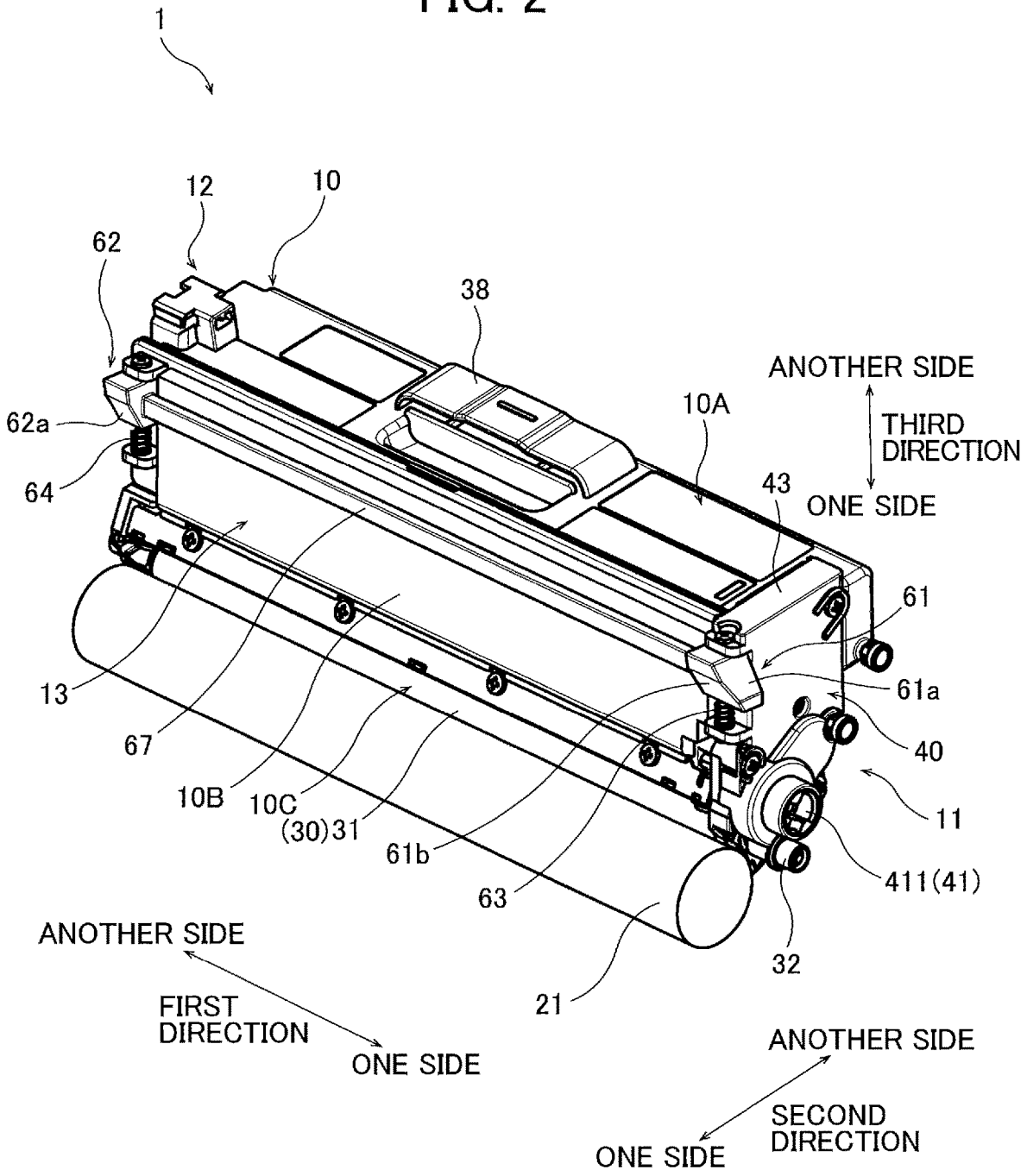
FIG. 2 is a perspective view of a developing cartridge according to one embodiment.

An overall structure of each developing cartridge 1 will be described next. FIG. 2 is a perspective view of the developing cartridge 1 according to the embodiment.

Figure 3:
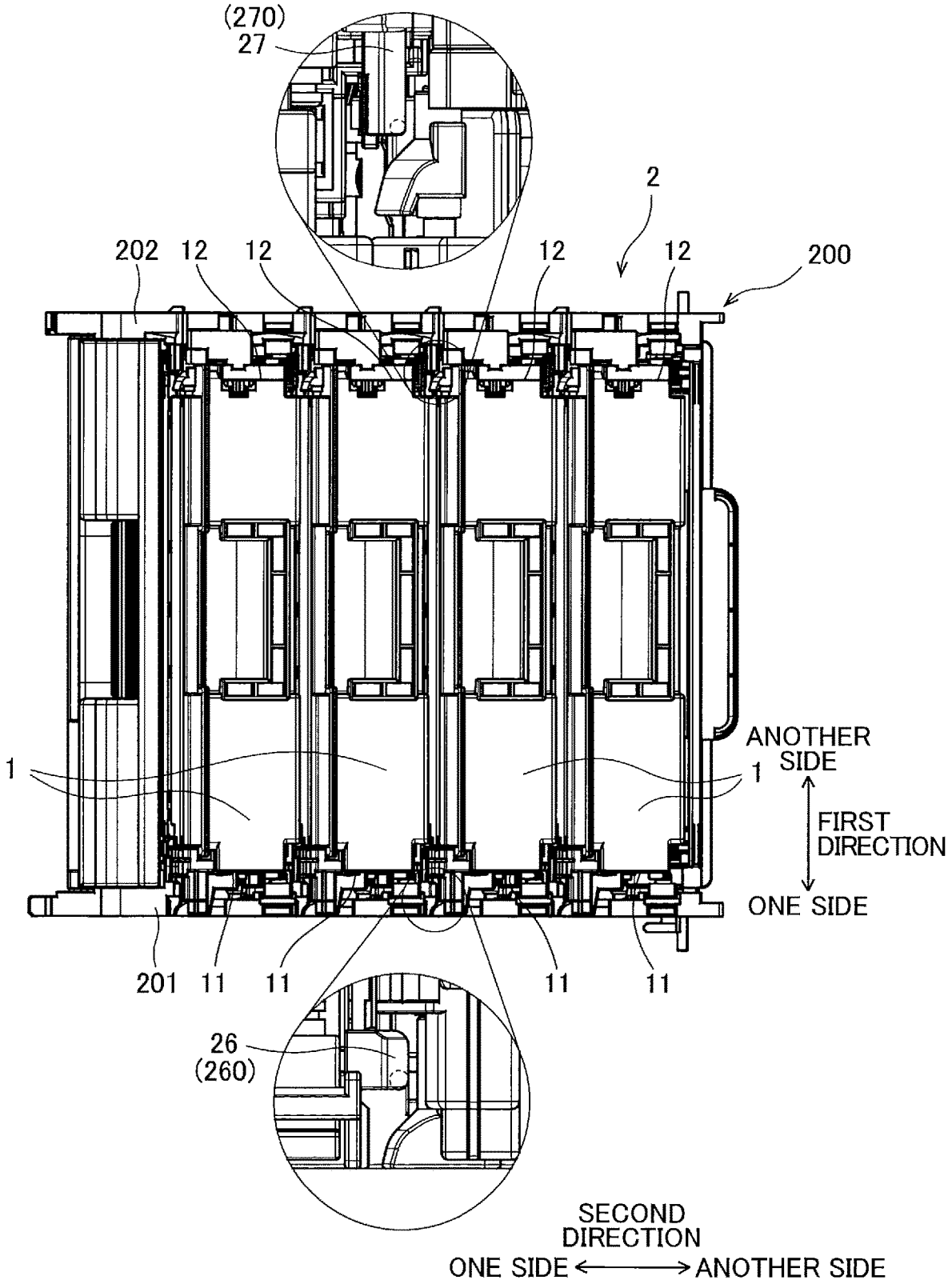
FIG. 3 is a view illustrating a drum cartridge to which the developing cartridge is attached as viewed from another side thereof in a third direction.

As illustrated in FIGS. 1 and 3, the developing cartridges 1 are attachable to and detachable from a frame 200 of the drum cartridge 2. As illustrated in FIG. 2, each developing cartridge 1 includes a casing 10 configured to store therein developing agent. The casing 10 includes a container portion 10A, and a lid portion 10B. The container portion 10A defines an internal space therein. The lid portion 10B is flat plate shaped. The lid portion 10B is positioned at one end portion of the casing 10 in the second direction. The lid portion 10B has a third outer surface 13 described later. The lid portion 10B covers an opening portion positioned at one end portion of the container portion 10A in the second direction. The container portion 10A has one end portion in the third direction where an opening 10C is formed. A developing roller 30 (described later) is positioned at the opening 10C.

The casing 10 has one end portion in the first direction which has a first outer surface 11. The casing 10 has another end portion in the first direction which has a second outer surface 12. The casing 10 also has the third outer surface 13 and a fourth outer surface 14 (FIG. 9) spaced away from each other in the second direction. The third outer surface 13 is positioned at one end portion of the casing 10 in the second direction. The fourth outer surface 14 is positioned at another end portion of the casing 10 in the second direction.

The four developing cartridges 1 accommodate therein toner of different colors (for example, cyan, magenta, yellow and black), respectively. However, the four developing cartridges 1 may accommodate therein toner of an identical color.

Each developing cartridge 1 includes one developing roller 30. The developing roller 30 is cylindrical in shape. The developing roller 30 is rotatable about a rotational axis (developing-roller axis) extending in the first direction. The developing roller 30 is supported by the casing 10 so as to be rotatable about the developing-roller axis.

The developing roller 30 includes a developing-roller body 31 and a developing-roller shaft 32. The developing-roller body 31 is hollow cylindrical in shape and extends in the first direction. The developing-roller body 31 is made from an elastic material, such as rubber. The developing-roller shaft 32 is a solid cylindrical member penetrating through the developing-roller body 31 in the first direction. The developing-roller shaft 32 is made from meal or electrically conductive resin. The developing-roller body 31 is fixed to the developing-roller shaft 32 without relative rotation therebetween. That is, the developing-roller body 31 is rotatable together with the developing-roller shaft 32 about the developing-roller axis. A part of an outer peripheral surface of the developing-roller body 31 in the second direction is exposed to the outside of the casing 10 through the opening 10C. A remaining part in the second direction of the outer peripheral surface of the developing-roller body 31 is positioned inside the casing 10.

The developing-roller shaft 32 has one end portion in the first direction. A developing-roller gear (not illustrated) is attached to the one end portion of the developing-roller shaft 32 in the first direction. The developing-roller gear is positioned at the first outer surface 11. The developing-roller gear is fixed to the one end portion of the developing-roller shaft 32 without relative rotation therebetween. Hence, a rotation of the developing-roller gear causes a rotation of the developing-roller shaft 32, so that the developing-roller body 31 is rotatable together with the developing-roller shaft 32.

Incidentally, the developing-roller shaft 32 may not extend through the developing-roller body 31 in the first direction. For example, the developing-roller shaft 32 may be configured of two shafts extending outward in the first direction respectively from both ends of the developing-roller body 31 in the first direction.

As illustrated in FIG. 2, each developing cartridge 1 also includes a gear portion 40. The gear portion 40 is positioned at the first outer surface 11 of the casing 10. The gear portion 40 includes the developing-roller gear described above, a coupling 41, and a gear cover 43.

The coupling 41 is a rotary member configured to receive a driving force supplied from a power source in the image-forming apparatus 100. The coupling 41 is rotatable about a rotational axis extending in the first direction. The coupling 41 has a fixing hole 411 recessed inward in the first direction. Upon attachment of the drum cartridge 2 to the main body portion 9 with the developing cartridges 1 attached to the drum cartridge 2, a transmission shaft (not shown) of the main body portion 9 is configured to be inserted in the fixing hole 411. The transmission shaft and the coupling 41 are thus connected each other without relative rotation therebetween. Accordingly, rotation of the transmission shaft causes rotation of the coupling 41. In accordance with the rotation of the coupling 41, the developing-roller gear rotates together with the developing roller 30. The rotation of the coupling 41 also causes rotations of a supply roller (not illustrated) and an agitator (not illustrated).

A handle 38 for being gripped by a user is positioned at an outer surface of another end portion of the casing 10 at the other side in the third direction.

<1-3. Overall Configuration of Drum Cartridge>

Next, an overall configuration of the drum cartridge 2 will be described next. FIG. 3 is a view of the drum cartridge 2 to which the developing cartridges 1 are attached as viewed from the other side thereof in the third direction. As illustrated in FIGS. 1 and 3, the drum cartridge 2 includes four of the photosensitive drums 21, and the frame 200.

Each of the four photosensitive drums 21 depicted in FIG. 1 has a cylindrical-shaped outer peripheral surface centered on a drum axis, which is a rotational axis extending in the first direction. The outer peripheral surface is a surface coated with photosensitive material. Each of the four photosensitive drums 21 is rotatable about the drum axis.

The frame 200 is a frame supporting the four photosensitive drums 21. The frame 200 holds the four photosensitive drums 21 such that the photosensitive drums 21 are spaced away from one another in the second direction. The frame 200 includes a pair of side frames 201, 202 opposite each other in the first direction. The side frame 202 is positioned further in the first direction toward the other side than the side frame 201. The photosensitive drums 21 are rotatably supported by the side frames 201 and 202.

For performing a printing process in the image-forming apparatus 100, the controller 102 drives a motor (not illustrated) so that the photosensitive drums 21 and the developing rollers 30 can rotate by a driving force transmitted from the motor through the transmission shaft and the coupling 41. Further, the controller 102 supplies power to the chargers (not illustrated) to charge the outer peripheral surfaces of the respective photosensitive drums 21. The controller 102 further causes the light sources (not illustrated) to emit light onto the outer peripheral surfaces of the respective photosensitive drums 21. In this way, an electrostatic latent image corresponding to a printing image is formed on the outer peripheral surface of each photosensitive drum 21. The toner accommodated in each developing cartridge 1 is then supplied through the corresponding developing roller 30 to the electrostatic latent image formed on the corresponding photosensitive drum 21. Thus, the electrostatic latent image becomes a visible toner image on the outer peripheral surface of each photosensitive drum 21.

Then, a printing sheet is conveyed between each photosensitive drum 21 and the transfer belt, whereby the toner image is transferred from the outer peripheral surface of each photosensitive drum 21 onto the printing sheet. The printing sheet carrying the toner image is then conveyed to a fixing unit (not illustrated) where the toner image is thermally fixed to the printing sheet. Image printing on the printing sheet is performed in this way.

In the image-forming apparatus 100, it may be preferable that the developing rollers 30 be separated from the corresponding photosensitive drums 21, for example, in order to change colors for printing or during a standby period. For this purpose, the image-forming apparatus 100 of the present embodiment provides a contacting state and a separated state. The contacting state denotes a state where the developing rollers 30 and the photosensitive drums 21 are in contact with each other in a state where the developing cartridges 1 are attached to the drum cartridge 2. The separated state denotes a state where the developing rollers 30 and the photosensitive drums 21 are separated from each other in the state where the developing cartridges 1 are attached to the drum cartridge 2.

To this effect, as components for realizing the contact and the separation, each developing cartridge 1 includes a first cam 61, a second cam 62, a first resilient member 63, a second resilient member 64, a first guide shaft 65, a second guide shaft 66, and a connection bar 67. Further, as components for realizing the contact and the separation, the drum cartridge 2 includes a first pressure contact portion 26 and a second pressure contact portion 27. As components for realizing the contact and the separation, the main body portion 9 includes four drive shafts 103.

<2. Components in Drum Cartridge for Contact and Separation>

Figure 4:
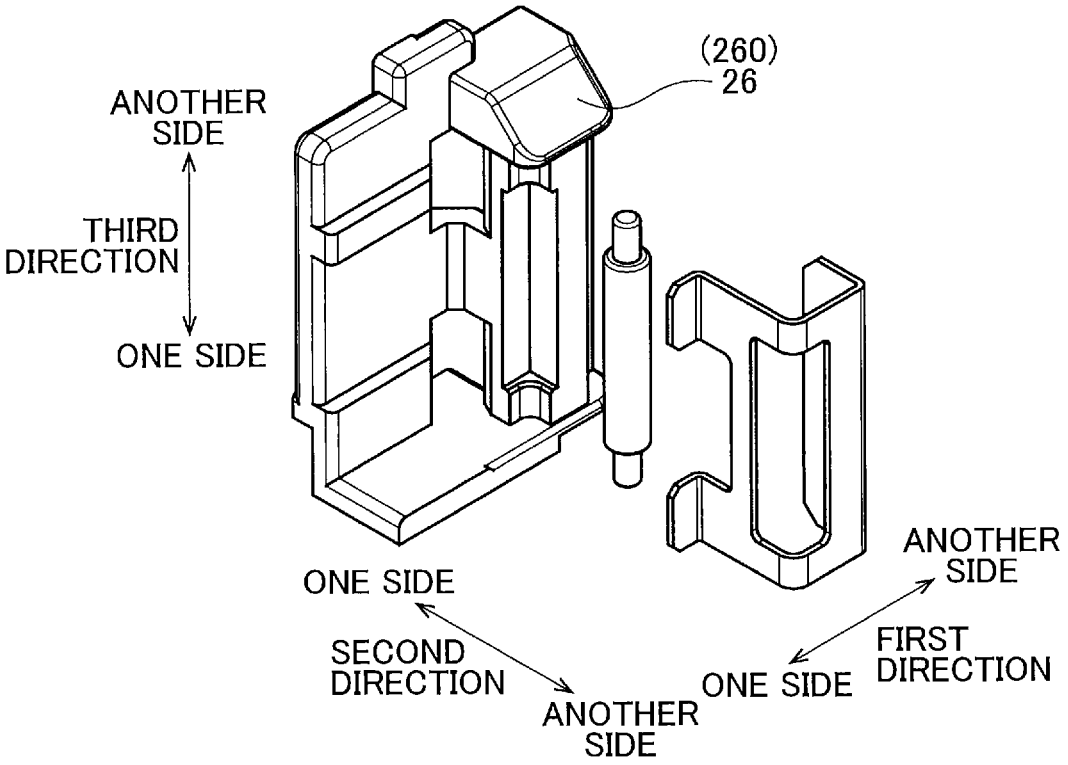
FIG. 4 is a perspective view of a first pressure contact portion which is a part of the drum cartridge.
Figure 5:
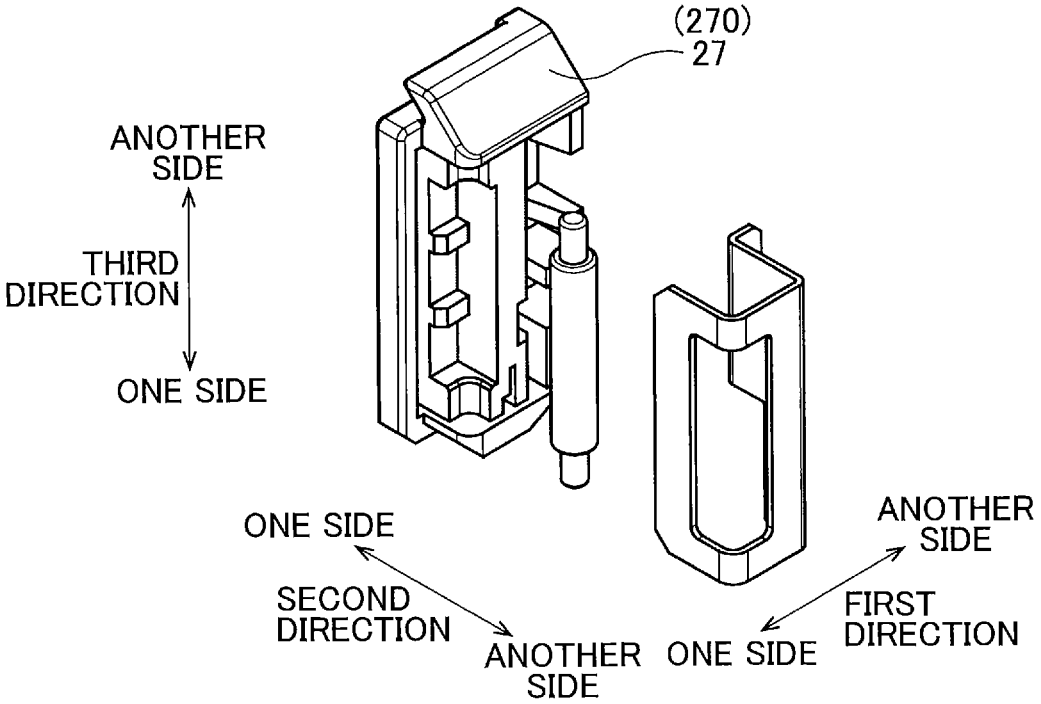
FIG. 5 is a perspective view of a second pressure contact portion which is a part of the drum cartridge.

Hereinafter, components of the drum cartridge 2 for performing the contact and the separation between the developing rollers 30 and the photosensitive drums 21 will be described with reference to FIGS. 3 through 5. FIG. 4 is an enlarged perspective view of the first pressure contact portion 26. FIG. 5 is an enlarged perspective view of the second pressure contact portion 27.

As illustrated in FIG. 3, in the state where the developing cartridges 1 are attached to the drum cartridge 2, the first outer surface 11 of each developing cartridge 1 faces an inner surface of the first side frame 201 in the first direction. Also, in the state where the developing cartridges 1 are attached to the drum cartridge 2, the second outer surface 12 of each developing cartridge 1 faces an inner surface of the second side frame 202 in the first direction.

As illustrated in an enlarged view in FIG. 3, the first side frame 201 includes four of the first pressure contact portions 26. That is, each first pressure contact portion 26 is positioned at one end portion of the frame 200 in the first direction. As illustrated in FIG. 4, each first pressure contact portion 26 has a first pressure contact surface 260 which is a flat surface slanting with respect to the second and third directions.

As illustrated in another enlarged view in FIG. 3, the second side frame 202 includes four of the second pressure contact portions 27. That is, each second pressure contact portion 27 is positioned at another end portion of the frame 200 at the other side in the first direction. As illustrated in FIG. 5, each second pressure contact portion 27 has a second pressure contact surface 270 which is a flat surface slanting with respect to the second and third directions.

The first pressure contact portion 26 and the corresponding second pressure contact portion 27 are positioned to be spaced away from each other in the first direction. As described later, the first cam 61 of each developing cartridge 1 is contactable with the first pressure contact surface 260 of the corresponding first pressure contact portion 26, and the second cam 62 of each developing cartridge 1 is contactable with the second pressure contact surface 270 of the corresponding second pressure contact portion 270.

<3. Components in Main Body Portion for Contact and Separation>

Next, components of the main body portion 9 for realizing the contact and separation between the developing rollers 30 and the photosensitive drums 21 will be described.

The main body portion 9 includes four drive shafts 103 (see FIGS. 9 and 12) as a component for performing the contact and the separation. Each drive shaft 103 is a solid cylinder or solid prismatic column extending in the first direction. The drive shaft 103 is movable in the first direction between an advanced position and a retracted position upon receiving a driving force from a power source of the main body portion 9.

<4. Components in Developing Cartridge for Contact and Separation>

Figure 6:
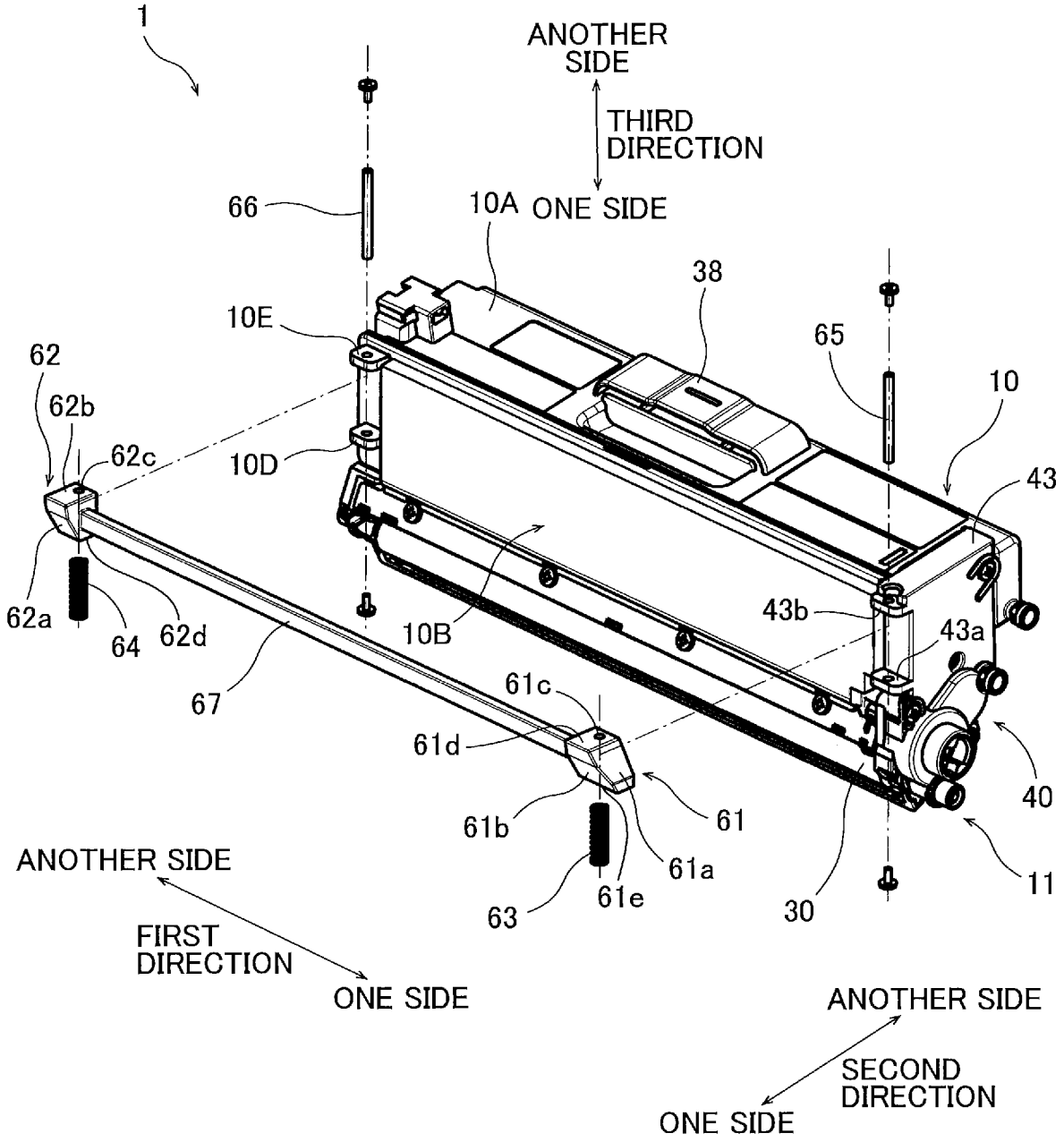
FIG. 6 is an exploded perspective view of the developing cartridge according to the embodiment.

Next, components of each developing cartridge 1 for realizing the contact and the separation between the developing roller 30 and the corresponding photosensitive drum 21 will be described with reference to FIGS. 2 and 6. FIG. 6 is an exploded perspective view of the developing cartridge 1.

As the components for the contact and separation, the developing cartridge 1 includes the first cam 61, the second cam 62, the first resilient member 63, the second resilient member 64, the first guide shaft 65, the second guide shaft 66, and the connection bar 67.

Figure 12:
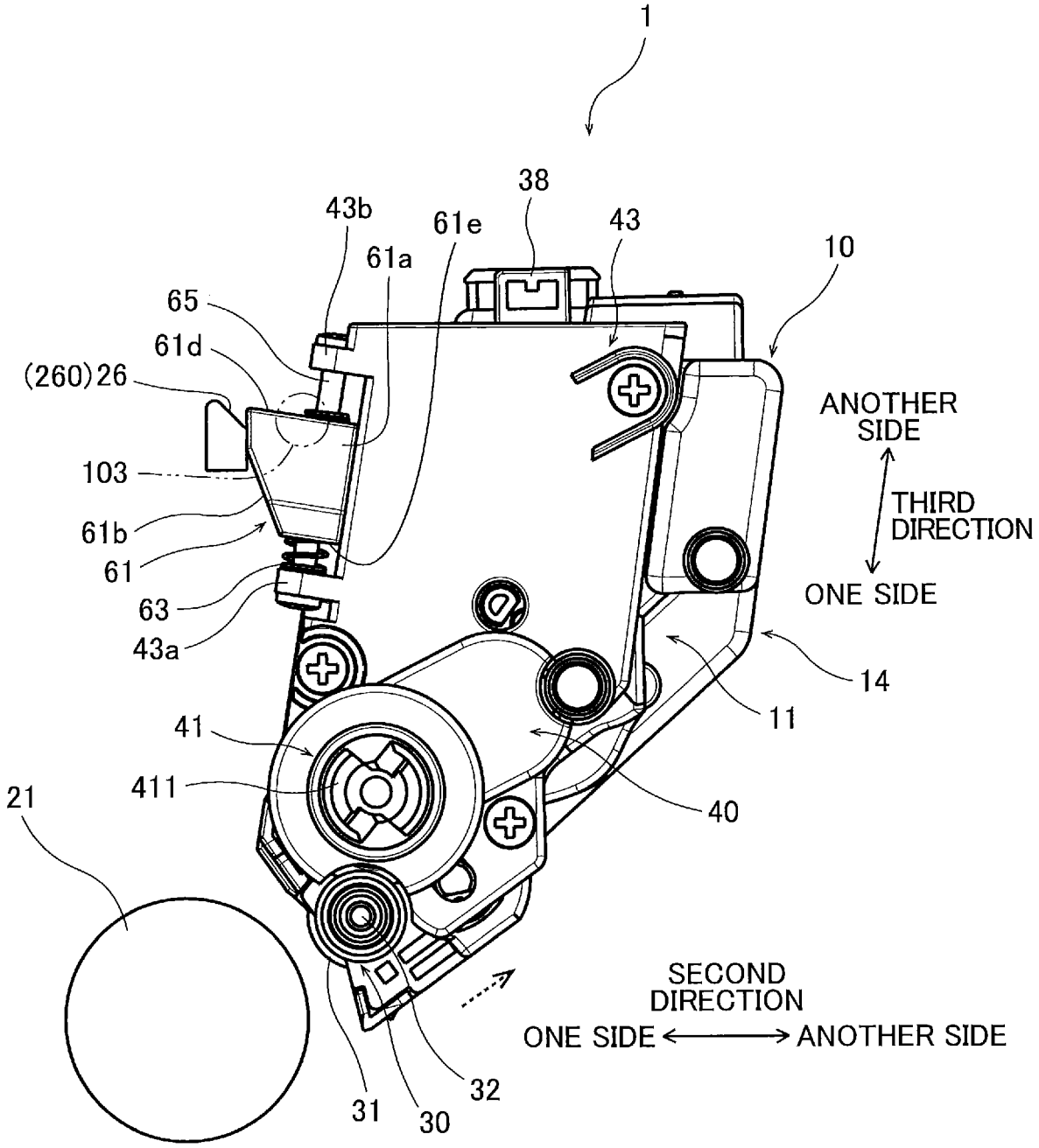
FIG. 12 is a view illustrating the developing cartridge according to the embodiment and the photosensitive drum in the separated state as viewed from one side thereof in the first direction.

As illustrated in FIGS. 2 and 6, the first cam 61 is positioned at the first outer surface 11 of the casing 10. Further, the first cam 61 is positioned at the third outer surface 13 of the casing 10. The first cam 61 has a first inclined surface 61*a*, a second inclined surface 61*b*, a first surface 61*e* (see FIGS. 6, 9), a second surface 61*d*, a first through-hole 61*c*, and a first recess 61*f* (see FIG. 9). As described later in detail, the first cam 61 is movable in the third direction relative to the casing 10 and the developing roller 30 between a first position (FIG. 9) and a second position (FIG. 12). The second position is closer to the developing roller 30 in the third direction than the first position is to the developing roller 30.

The first inclined surface 61*a* is a flat surface sloping with respect to the first direction and the third direction. The first inclined surface 61*a* is parallel to the second direction. Specifically, the first inclined surface 61*a* is sloped to be distant from the first outer surface 11 in the first direction as extending toward the developing roller 30 in the third direction.

The second inclined surface 61*b* is a flat surface sloping with respect to the second direction and the third direction. The second inclined surface 61*b* is parallel to the first direction. Specifically, the second inclined surface 61*b* is sloped to extend toward the third outer surface 13 in the second direction as approaching the developing roller 30 in the third direction. That is, a distance between the second inclined surface 61*b* and the casing 10 in the second direction increases as the second inclined surface 61*b* extends away from the developing roller 30 in the third direction.

The first inclined surface 61*a* and the second inclined surface 61*b* are different surfaces of the first cam 61. The first inclined surface 61*a* is generally trapezoidal in shape as viewed from one side thereof in the first direction. The trapezoidal shape has a short side at one side thereof in the third direction and a long side at the other side thereof in the third direction. The second inclined surface 61*b* is generally trapezoidal in shape as viewed from one side thereof in the second direction. The trapezoidal shape has a long side at the one side in the third direction and a short side at the other side in the third direction. The first inclined surface 61*a* has a hypotenuse at the one side in the second direction that is connected to a hypotenuse of the second inclined surface 61*b* at the one side in the first direction.

The first cam 61 also has the first surface 61*e* and the second surface 61*d*. The first surface 61*e* and the second surface 61*d* are perpendicular to the third direction. The first surface 61*e* is at one end portion of the first cam 61 at the one side in the third direction. The second surface 61*d* is at another end portion of the first cam 61 at the other side in the third direction.

The first through-hole 61*c* extends in the third direction throughout the first cam 61. The first through-hole 61*c* has a circular cross-section. The first through-hole 61*c* has an end at the other side in the third direction that is open at the second surface 61*d* of the first cam 61.

The first recess 61*f* is recessed at the first surface 61*e* in the third direction toward the other side (toward the second surface 61*d*). The first recess 61*f* has a cross-sectional area greater than a cross-sectional area of the first through-hole 61*c*. The first through-hole 61*c* has one end in the third direction (at the one side) that is connected to an inner space of the first recess 61*f*.

The first resilient member 63 is a coil spring extending in the third direction. The first resilient member 63 is expandable and shrinkable in the third direction. The first resilient member 63 has one end portion seated on a bottom of the first recess 61*f* (see FIG. 9). That is, the one end portion of the first resilient member 63 is accommodated in the inner space of the first recess 61*f*. The first resilient member 63 has another end portion connected to a first seat member 43*a* (see FIG. 9). The first seat member 43*a* protrudes toward the one side (outward) in the second direction from a side wall of the gear cover 43 positioned at one side thereof in the second direction. The first seat member 43*a* has a first flat surface perpendicular to the third direction. The other end portion of the first resilient member 63 is seated on the first flat surface of the first seat member 43*a*. The first resilient member 63 is interposed between the bottom of the first recess 61*f* and the first flat surface of the first seat member 43*a* such that the first resilient member 63 is compressed in the third direction to have a smaller length than a natural length thereof.

The first guide shaft 65 extends in the third direction, and has a solid cylindrical shape or solid prismatic columnar shape. The first guide shaft 65 is positioned at the third outer surface 13 of the casing 10. The first guide shaft 65 is positioned inside the first resilient member 63. The first guide shaft 65 has one end connected to the first flat surface of the first seat member 43*a*. The first guide shaft 65 is inserted in the first through-hole 61*c*. Hence, the first guide shaft 65 extends throughout the first cam 61 in the third direction.

The first guide shaft 65 has another end in the third direction connected to a second seat member 43*b* (see FIG. 6). The second seat member 43*b* protrudes toward the one side (outward) in the second direction from the side wall of the gear cover 43 positioned at one side thereof in the second direction. The second seat member 43*b* is positioned further in the third direction toward the other side than the first seat member 43*a*. The second seat member 43*b* has a second flat surface perpendicular to the third direction. The other end of the first guide shaft 65 in the third direction is seated on the second flat surface of the second seat member 43*b*.

The one end of the first guide shaft 65 is fixed to the first flat surface of the first seat member 43*a* by a fastener of a well-known configuration, such as a screw and a pin. The other end of the first guide shaft 65 is fixed to the second flat surface of the second seat member 43*b* by a fastener of a well-known configuration, such as a screw and a pin. That is, each end of the first guide shaft 65 in the third direction is supported by the casing 10 through the gear cover 43. The first cam 61 is movable in the third direction along the first guide shaft 65. The first resilient member 63 urges the first cam 61 in the third direction toward the other side (from the one end portion toward the other end portion in the third direction of the casing 10). Hence, the first cam 61 is urged by an urging force of the first resilient member 63 toward the first position (FIG. 9) from the second position (FIG. 12).

Figure 11:
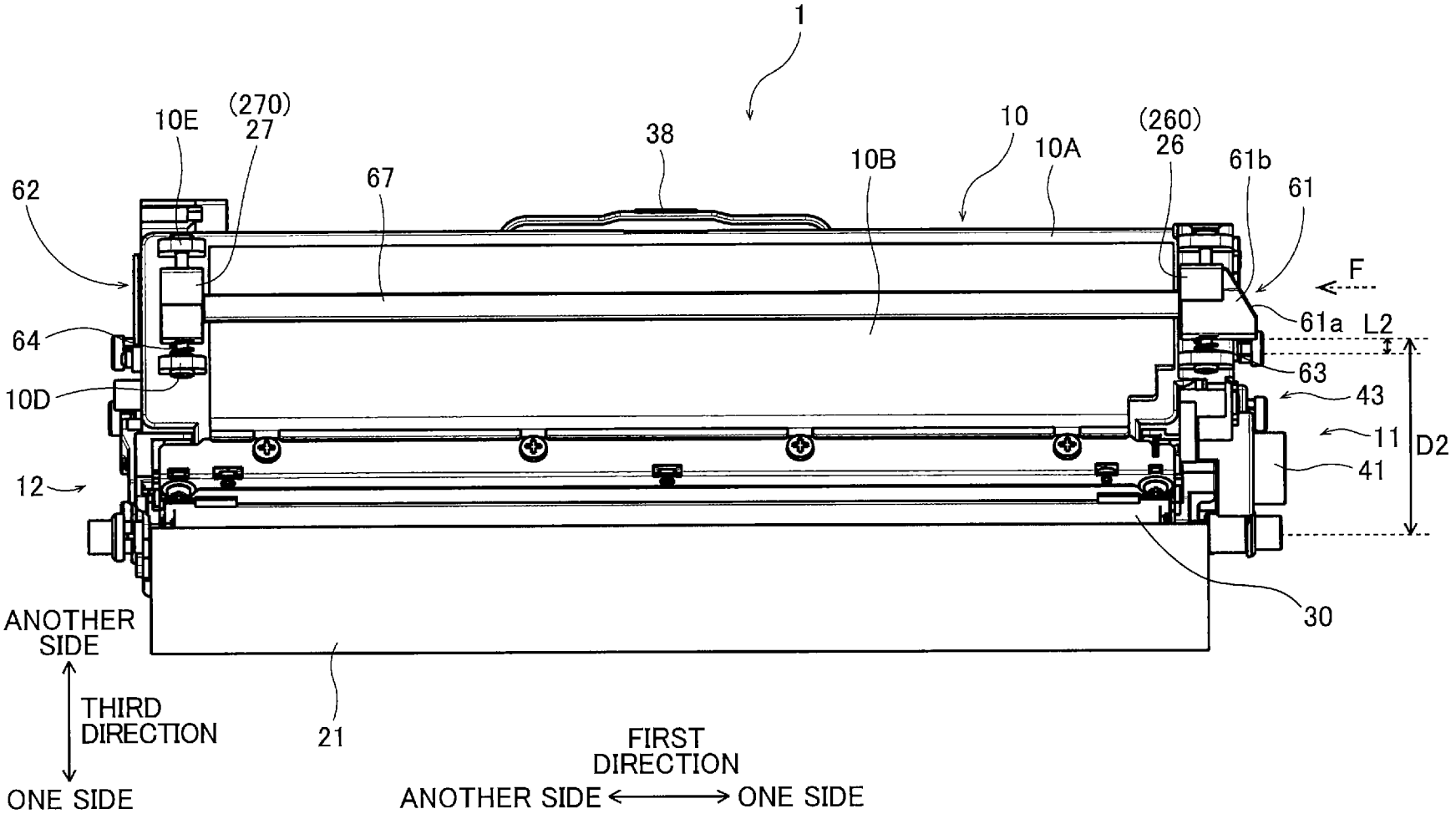
FIG. 11 is a view of the developing cartridge according to the embodiment and the photosensitive drum in the separated state as viewed from one side thereof in the second direction.

As illustrated in FIGS. 2 and 6, the second cam 62 is positioned at the first outer surface 11 of the casing 10. Further, the second cam 62 is positioned at the third outer surface 13 of the casing 10. The second cam 62 has a third inclined surface 62*a*, a third surface 62*d*, a fourth surface 62*b*, a second through-hole 62*c*, and a second recess (not illustrated). As described later in detail, the second cam 62 is movable in the third direction relative to the casing 10 and the developing roller 30 between a third position (FIG. 8) and a fourth position (FIG. 11). The fourth position is closer to the developing roller 30 in the third direction than the third position is to the developing roller 30. The second cam 62 is movable from the third position to the fourth position in accordance with the movement of the first cam 61 from the first position to the second position.

The third inclined surface 62*a* is a flat surface sloping with respect to the second direction and the third direction. The third inclined surface 62*a* is parallel to the first direction. Specifically, the third inclined surface 62*a* is sloped to extend toward the third outer surface 13 in the second direction as approaching toward the developing roller 30 in the third direction. That is, a distance between the third inclined surface 62*a* and the casing 10 in the second direction increases as the third inclined surface 62*a* extends away from the developing roller 30 in the third direction.

The third inclined surface 62*a* is generally trapezoidal in shape as viewed in the second direction from the one side toward the other side. The trapezoidal shape has a long side at the one side in the third direction and a short side at the other side in the third direction. The second cam 62 has the third surface 62*d* and the fourth surface 62*b*. The third surface 62*d* and the fourth surface 62*b* are perpendicular to the third direction. The third surface 62*d* is at one end of the second cam 62 in the third direction. The fourth surface 62*b* is positioned further in the third direction toward the other side than the second cam 62 in the second cam 62.

The second through-hole 62*c* extends in the third direction throughout the second cam 62. The second through-hole 62*c* has a circular cross-section. The second through-hole 62*c* has an end at the other side in the third direction that is open at the fourth surface 62*b* of the second cam 62.

The second recess (not illustrated) is recessed at the third surface 62*d* in the third direction toward the other side (toward the fourth surface 62*b*). The second recess has a cross-sectional area greater than a cross-sectional area of the second through-hole 62*c*. The second through-hole 62*c* has one end at the one side in the third direction that is connected to an inner space of the second recess.

The second resilient member 64 is a coil spring extending in the third direction. The second resilient member 64 is expandable and shrinkable in the third direction. The second resilient member 64 has one end portion seated on a bottom of the second recess. That is, the one end portion of the second resilient member 64 is accommodated in the inner space of the second recess. The second resilient member 64 has another end portion connected to a third seat member 10D (FIG. 6). The third seat member 10D protrudes from the third outer surface 13 of the casing 10 toward the one side (outward) in the third direction. The third seat member 10D has a third flat surface perpendicular to the third direction. The other end portion of the second resilient member 64 in the third direction is seated on the third flat surface of the third seat member 10D. The second resilient member 64 is interposed between the bottom of the second recess and the third flat surface of the third seat member 10D, such that the second resilient member 64 is compressed in the third direction to have a smaller length than a natural length thereof.

The second guide shaft 66 extends in the third direction, and has a solid cylindrical shape or solid prismatic columnar shape. The second guide shaft 66 is positioned at the third outer surface 13 of the casing 10. The second guide shaft 66 is positioned inside the second resilient member 64. The second guide shaft 66 has one end connected to the third flat surface of the third seat member 10D. The second guide shaft 66 is inserted in the second through-hole 62*c*. Hence, the second guide shaft 66 extends throughout the second cam 62 in the third direction.

The second cam 62 has another end connected to a fourth seat member 10E (FIG. 6). The fourth seat member 10E protrudes from the third outer surface 13 of the casing 10 toward the one side in the second direction. The fourth seat member 10E is positioned further in the third direction toward the other side than the third seat member 10D. The fourth seat member 10E has a fourth flat surface perpendicular to the third direction. The other end of the second guide shaft 66 in the third direction is seated on the fourth flat surface of the fourth seat member 10E.

The one end of the second guide shaft 66 is fixed to the third flat surface of the third seat member 10D by a fastener of a well-known configuration, such as a screw and a pin. The other end of the second guide shaft 66 is fixed to the fourth flat surface of the fourth seat member 10E by a fastener of a well-known configuration, such as a screw and a pin. Hence, each end of the second guide shaft 66 in the third direction is supported by the casing 10. The second cam 62 is movable in the third direction along the second guide shaft 66. The second resilient member 64 urges the second cam 62 in the third direction toward the other side (from the one end portion to the other end portion of the casing 10 in the third direction). Hence, the second cam 62 is urged by an urging force of the second resilient member 64 toward the third position from the fourth position.

The connection bar 67 extends in the first direction and has a solid prismatic columnar shape or solid cylindrical shape. The connection bar 67 is positioned between the first cam 61 and the second cam 62 in the first direction. The connection bar 67 connects the first cam 61 to the second cam 62. Specifically, the first cam 61 is connected to one end portion of the connection bar 67 at the one side in the first direction. The second cam 62 is connected to another end portion of the connection bar 67 at the other side in the first direction. Hence, the second cam 62 is movable in the third direction in interlocking relation to the first cam 61.

<5. Movement of Each Component at the Time of Switching Between Contact and Separation>

Hereinafter, how each component operates for realizing switching between the contact and the separation will be described with reference to FIGS. 7 through 12.

Figure 7:
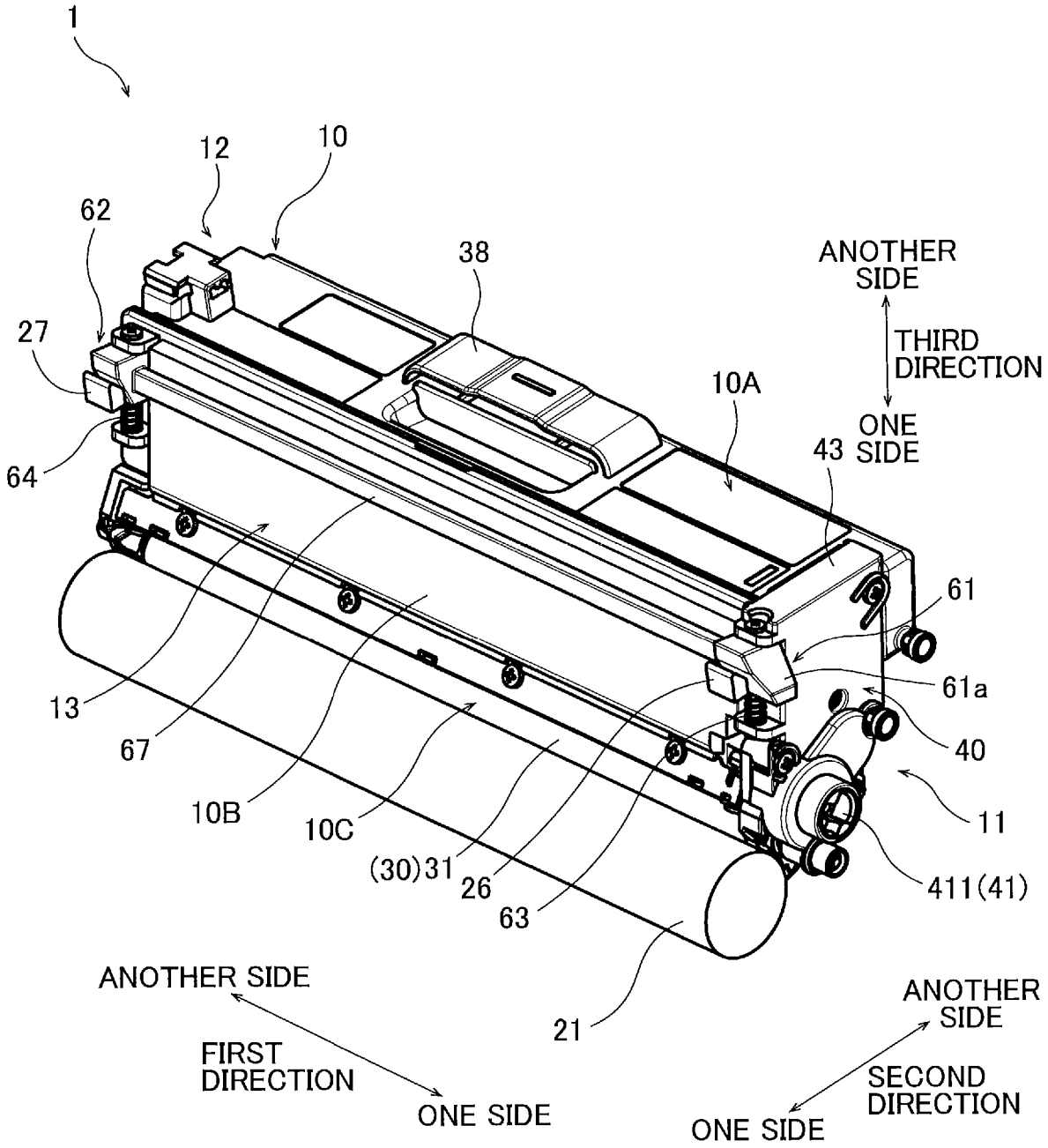
FIG. 7 is a perspective view illustrating the developing cartridge according to the embodiment and a photosensitive drum in a contacting state.
Figure 8:
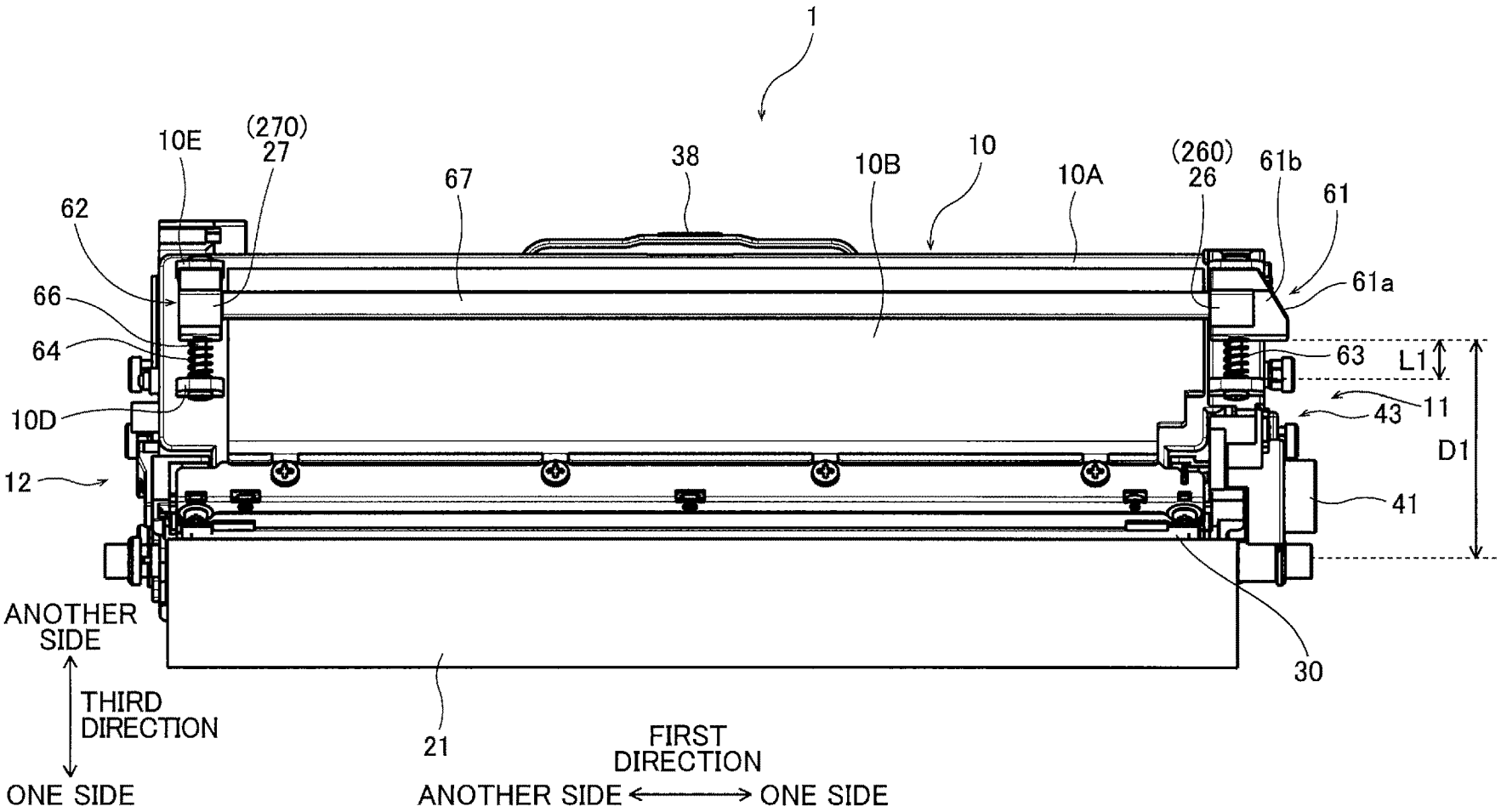
FIG. 8 is a view of the developing cartridge according to the embodiment and the photosensitive drum in the contacting state as viewed from one side thereof in a second direction.
Figure 9:
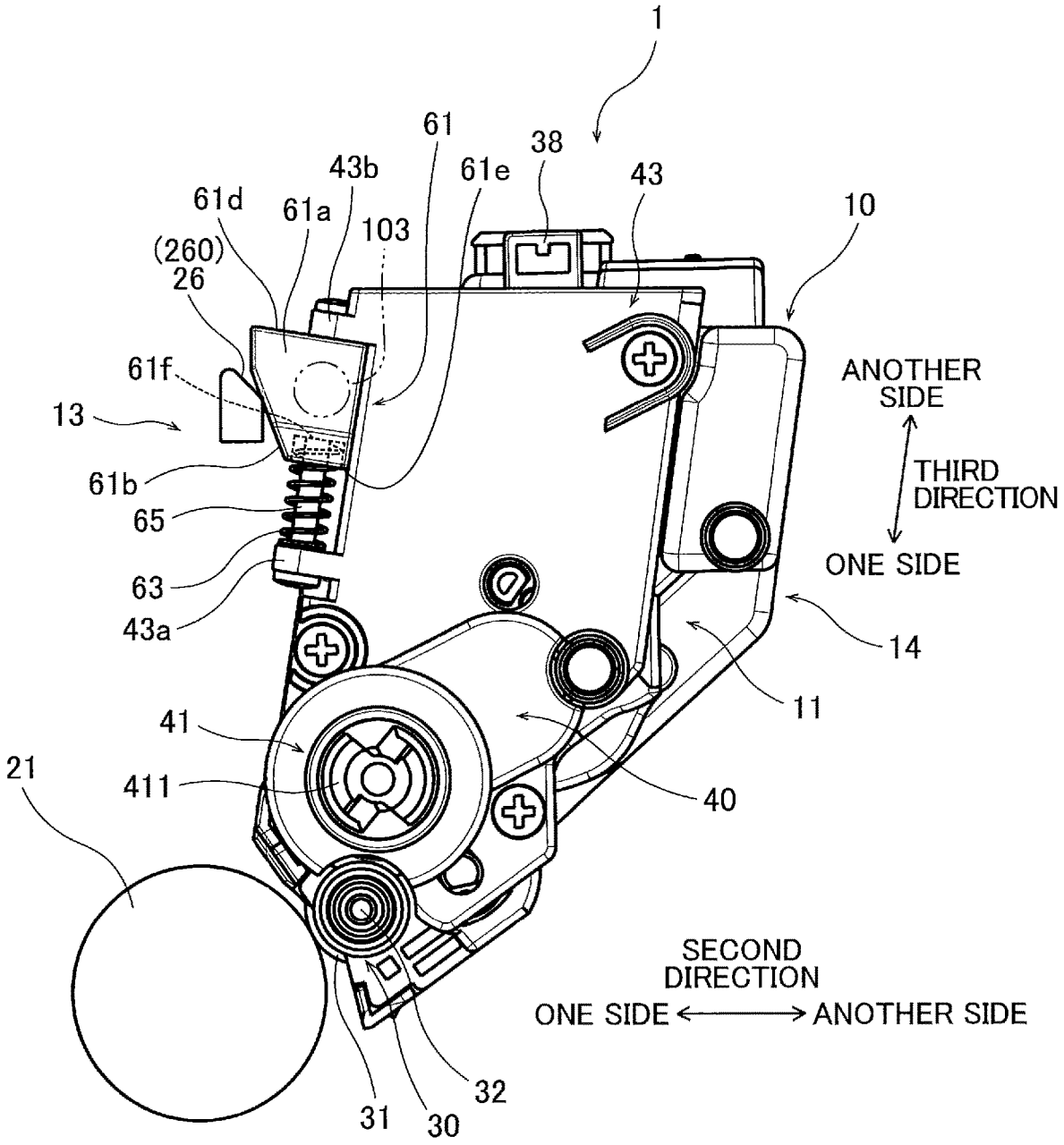
FIG. 9 is a view of the developing cartridge according to the embodiment and the photosensitive drum in the contacting state as viewed from one side thereof in a first direction.
Figure 10:
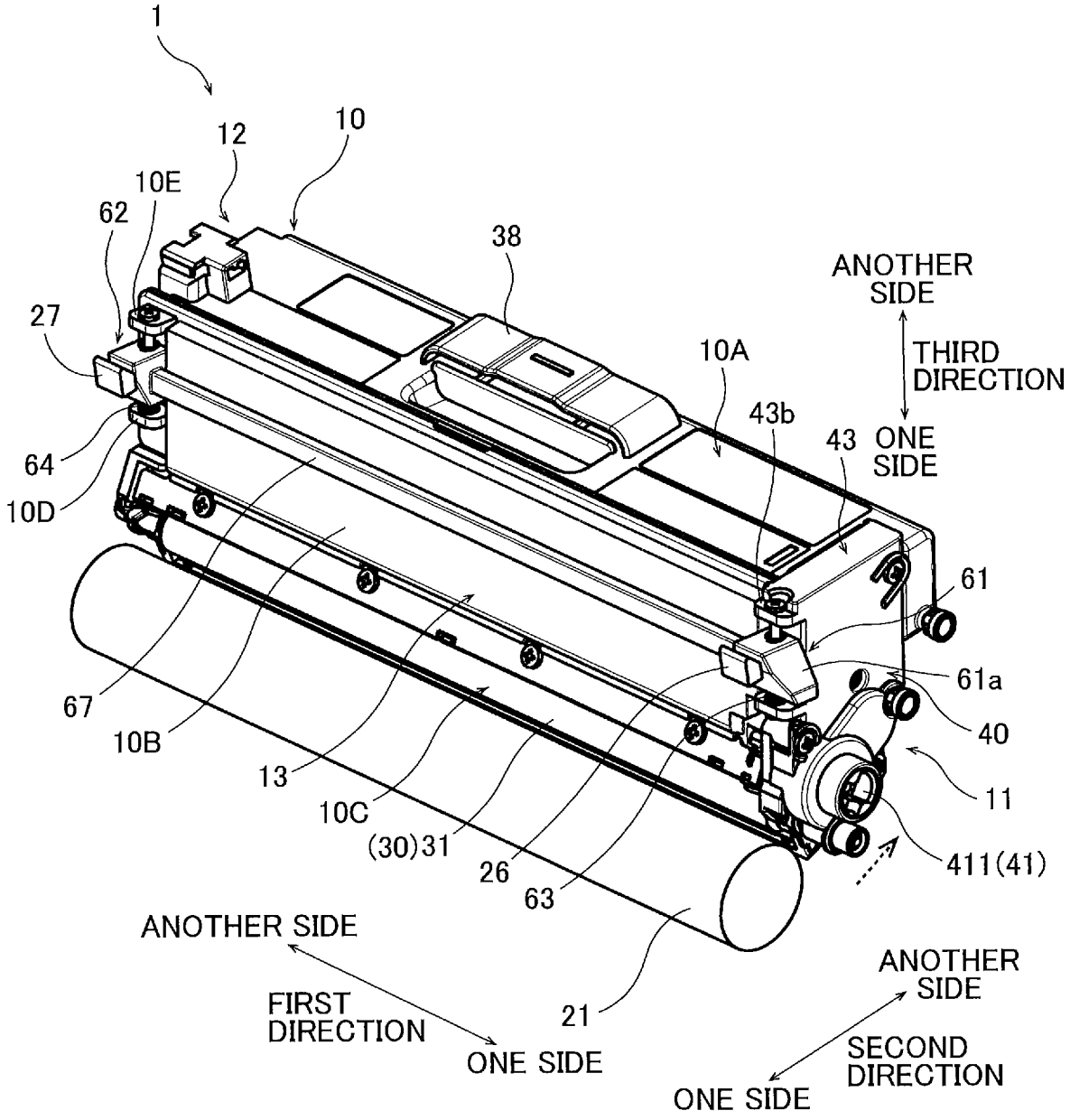
FIG. 10 is a perspective view of the developing cartridge according to the embodiment and the photosensitive drum in a separated state.

FIG. 7 is a perspective view illustrating the developing cartridge 1 and the photosensitive drum 21 in the contacting state. FIG. 8 is a view of the developing cartridge 1 and the photosensitive drum 21 in the contacting state as viewed from one side thereof in the second direction. FIG. 9 is a view of the developing cartridge 1 and the photosensitive drum 21 in the contacting state as viewed from one side thereof in the first direction. FIG. 10 is a perspective view of the developing cartridge 1 and the photosensitive drum 21 in the separated state. FIG. 11 is a view of the developing cartridge 1 and the photosensitive drum 21 in the separated state as viewed from one side thereof in the second direction. FIG. 12 is a view illustrating the developing cartridge 1 and the photosensitive drum 21 in the separated state as viewed from one side thereof in the first direction.

In the image-forming apparatus 100, in a case where the drive shaft 103 is driven or moved toward the other side in the first direction to the advanced position, the first inclined surface 61*a* of the corresponding first cam 61 is pressed by the drive shaft 103. That is, the first inclined surface 61*a* of the first cam 61 receives a pressing force F directing from the one end portion toward the other end portion of the casing 10 in the first direction.

The pressing force F applied to the first inclined surface 61*a* from the drive shaft 103 is converted into a force directing in the third direction by contact of the drive shaft 103 with the first inclined surface 61*a*. The first cam 61 is thus pressed toward the one side in the third direction. As the pressing force F pressing the first cam 61 toward the one side in the third direction is greater than the urging force of the first resilient member 63, the first cam 61 at the first position is caused to move in the third direction toward the one side to be at the second position.

In the meantime, the second inclined surface 61*b* is in contact with the first pressure contact surface 260 of the first pressure contact portion 26. In accordance with the movement of the first cam 61, a contacting position between the second inclined surface 61*b* and the first pressure contact surface 260 is shifted over the second inclined surface 61*b* from a position close to the first surface 61*e* to a position close to the second surface 61*d*. As a result, a distance between the first pressure contact surface 260 of the first pressure contact portion 26 and the casing 10 in the second direction is gradually increased. Since the second inclined surface 61*b* is pressed by the first pressure contact surface 260 of the first pressure contact portion 26, the casing 10 and the developing roller 30 move together with the first cam 61 in the second direction to separate the developing roller 30 from the corresponding photosensitive drum 21.

According to another aspect, because of the contact between the second inclined surface 61*b* and the first pressure contact surface 260 of the first pressure contact portion 26, the force moving the first cam 61 toward the one side in the third direction is converted into the force pressing the first cam 61 in the second direction toward the other side. As a result, the casing 10 and the developing roller 30 move together with the first cam 61 in the second direction toward the other side, thereby separating the developing roller 30 from the photosensitive drum 21.

Thereafter, in a case where the drive shaft 103 is retracted in the first direction toward the one side (from the other end portion to the one end portion of the casing 10 in the first direction), the first cam 61 moves toward the other side in the third direction by the urging force of the first resilient member 63. Hence, the first cam 61 moves from the second position to the first position.

Here, the frame 200 of the drum cartridge 2 includes a pressure mechanism (not illustrated) for pressing the casing 10 of each developing cartridge 1 toward the corresponding photosensitive drum 21. Since the pressure mechanism moves the developing cartridge 1 in the second direction toward the one side in this state, the contacting state between the developing roller 30 and the corresponding photosensitive drum 21 is restored. In this way, the state of image forming apparatus 100 is switchable between the contacting state (FIGS. 7 through 9) and the separated state (FIGS. 10 through 12).

In accordance with the movement of the first cam 61 between the first position and the second position, the second cam 62 also moves between the third position and the fourth position through the connection bar 67. By the movement of the second cam 62, the third inclined surface 62*a* is pressed by the second pressure contact surface 270 of the second pressure contact portion 27, so that the casing 10 and the developing roller 30 move in the second direction together with the second cam 62. In this way, both end portions of the casing 10 in the first direction are respectively pressed by the first pressure contact portion 26 and the second pressure contact portion 27, which are components of the drum cartridge 2, to move the casing 10 in the second direction toward the other side. Accordingly, this structure can reduce a likelihood that the casing 10 may be slanted with respect to the first direction at the time of switching between the contacting state and the separated state.

Incidentally, as illustrated in FIG. 9, in the attached state of the developing cartridge 1 to the drum cartridge 2 and the first cam 61 is at the first position, the second inclined surface 61*b* is in contact with the first pressure contact surface 260 of the first pressure contact portion 26 which is part of the drum cartridge 2. On the other hand, as illustrated in FIG. 12, in the attached state of the developing cartridge 1 to the drum cartridge 2 and the first cam 61 is at the second position, the second inclined surface 61*b* is separated from the first pressure contact surface 260 of the first pressure contact portion 26. In accordance with the movement of the first cam 61 from the first position to the second position, the second inclined surface 61*b* is gradually pressed by the first pressure contact surface 260 in the second direction toward the other side. The first cam 61 is accordingly moved, together with the casing 10 and the developing roller 30, to be separated away from the corresponding photosensitive drum 21 in the second direction.

As illustrated in FIGS. 7 and 9, the developing roller 30 is in contact with the corresponding photosensitive drum 21 when the first cam 61 is at the first position. At this time, the first resilient member 63 has a first length L1 in the third direction; and the first cam 61 and the developing roller 30 define a first distance D1 therebetween in the third direction.

As illustrated in FIGS. 10 and 12, the developing roller 30 is separated from the photosensitive drum 21 when the first cam 61 is at the second position. At this time, the first resilient member 63 has a second length L2 in the third direction smaller than the first length L1; and the first cam 61 and the developing roller 30 define a second distance D2 therebetween in the third direction smaller than the first distance D1.

Similarly, in the attached state of the developing cartridge 1 to the drum cartridge 2 and the second cam 62 is at the third position, the third inclined surface 62*a* is in contact with the second pressure contact surface 270 of the second pressure contact portion 27 which is part of the drum cartridge 2. At this time, the developing roller 30 is in contact with the corresponding photosensitive drum 21. On the other hand, in the attached state of the developing cartridge 1 to the drum cartridge 2 and the second cam 62 is at the fourth position, the third inclined surface 62*a* is separated from the second pressure contact surface 270 of the second pressure contact portion 27. At this time, the developing roller 30 is in separation from the photosensitive drum 21.

<6. Summary>

As described above, the developing cartridge 1 according to the embodiment includes the casing 10, the developing roller 30, and the first cam 61. The first cam 61 has the first inclined surface 61*a*, and the second inclined surface 61*b*. In the developing cartridge 1, the first cam 61 is movable between the first position and the second position in response to the application of the pressing force F to the first inclined surface 61*a*. During the movement of the first cam 61 between the first position and the second position, the second inclined surface 61*b* is pressed by the first pressure contact surface 260 which is a part of the drum cartridge 2. Hence, the developing roller 30 can be separated from the corresponding photosensitive drum 21.

As such, in the developing cartridge 1 according to the embodiment, separation of the developing roller 30 from the corresponding photosensitive drum 21 can be performed by the driving force applied only to the one side in the first direction of the developing cartridge 1. Application of driving force to both sides in the first direction of the developing cartridge 1 is unnecessary.

Further, in the developing cartridge 1 according to the embodiment, the first inclined surface 61*a* is inclined with respect to the first direction. The pressing force F applied to the first inclined surface 61*a* is converted to the force directing in the third direction by the inclination of the first inclined surface 61*a*. As a result, the first cam 61 can move in the third direction between the first position and the second position.

Further, in the developing cartridge 1 according to the embodiment, the second inclined surface 61*b* is inclined with respect to the second direction and the third direction. Hence, the pressing force F for moving the first cam 61 from the first position to the second position is converted into pressing force of the first pressure contact surface 260 which is the part of the drum cartridge 2 for moving the second inclined surface 61*b* in the second direction. As a result, the casing 10 and the developing roller 30 can move in the second direction, thereby separating the developing roller 30 from the corresponding photosensitive drum 21.

Further, the developing cartridge 1 according to the embodiment includes the first resilient member 63. Hence, the first cam 61 can be returned to the first position by the urging force of the first resilient member 63, after the first cam 61 moves from the first position to the second position by the pressing force F applied to the second inclined surface 61*b* of the first cam 61 from the first pressure contact surface 260 which is the part of the drum cartridge 2. Further, the second inclined surface 61*b* can easily move along the first pressure contact surface 260.

Further, in the developing cartridge 1 according to the embodiment, the first resilient member 63 is a coil spring. The first cam 61 is allowed to move between the first position and the second position in accordance with expansion and shrinkage of the coil spring.

Further, in the developing cartridge 1 according to the embodiment, the first cam 61 has the first recess 61*f*. The one end portion of the first resilient member 63 is positioned at the bottom portion of the first recess 61*f*. Since the one end portion of the first resilient member 63 is accommodated in the first recess 61*f*, a larger stroke of expansion/shrinkage of the first resilient member 63 can be obtained than otherwise.

Further, the developing cartridge 1 according to the embodiment includes the first guide shaft 65. The first cam 61 is movable in the third direction along the first guide shaft 65. Hence, movement of the first cam 61 in the third direction between the first position and the second position can be realized at high accuracy.

Further, in the developing cartridge 1 according to the embodiment, the first guide shaft 65 is positioned inside the first resilient member 63. Hence, deflection of the first resilient member 63 in a direction crossing the third direction can be restrained. As a result, accurate operations of the first cam 61 can be attained.

Further, in the developing cartridge 1 according to the embodiment, the first guide shaft 65 extends throughout the first cam 61 in the third direction. Hence, space saving layout of the first guide shaft 65 and the first cam 61 can be attained. Further, the first cam 61 can move in the third direction at high accuracy because the movement of the first cam 61 is guided by the first guide shaft 65.

Further, the main body portion 9 which can accommodate the drum cartridge 2 includes the drive shafts 103. The first cam 61 moves from the first position to the second position in accordance with the application of the pressing force F to the first inclined surface 61*a* from the corresponding drive shaft 103. Hence, the developing roller 30 can be separated from the photosensitive drum 21 by the driving force applied from the main body portion 9.

Further, the developing cartridge 1 according to the embodiment includes the second cam 62. The second cam 62 has the third inclined surface 62*a*. The third inclined surface 62*a* is pressed by the second pressure contact surface 270 which is a part of the drum cartridge 2 during movement of the third inclined surface 62*a* between the third position and the fourth position. Because the second inclined surface 61*b* and the third inclined surface 62*a* are positioned at the one end portion and the other end portion of the casing 10 in the first direction, respectively, the one end portion and the other end portion in the first direction of the casing 10 can be pressed by the first pressure contact surface 260 and the second pressure contact surface 270, respectively, which are parts of the drum cartridge 2. As a result, the developing roller 30 can be securely separated from the corresponding photosensitive drum 21.

Further, in the developing cartridge 1 according to the embodiment, the third inclined surface 62*a* is inclined with respect to the second direction and the third direction. Therefore, the force for moving the second cam 62 from the third position to the fourth position is converted into the force applying from the second pressure contact surface 270 (the part of the drum cartridge 2) for moving the third inclined surface 62*a* in the second direction. As a result, the casing 10 and the developing roller 30 can be moved in the second direction, thereby separating the developing roller 30 from the corresponding photosensitive drum 21.

Further, the developing cartridge 1 according to the embodiment includes the connection bar 67 for connecting the first cam 61 and the second cam 62 together. Hence, interlocking movement of the first cam 61 and the second cam 62 can be attained. Accordingly, inclined posture of the developing cartridge 1 with respect to the first direction can be restrained in the state where the developing cartridge 1 is separated from the corresponding photosensitive drum 21.

<7. Modifications>

While the description has been made in detail with reference to the above embodiment, it would be apparent to those skilled in the art that many modifications and variations may be made therein without departing from the scope of the disclosure.

For example, in the above-described embodiment, the first guide shaft 65 is inserted in the first through-hole 61*c* of the first cam 61. Instead, the first cam may have a groove extending throughout a length thereof in the third direction, and the first guide shaft may be inserted in the groove.

In the above-described embodiment, the pressure contact portions 26 and 27 have the pressure contact surfaces 260, 270, respectively, which have inclined flat surfaces. Instead, the pressure contact portions may be cylindrical members rotatable about rotation axes extending in the first direction.

In the above-described embodiment, the first resilient member 63 and the second resilient member 64 are compression coil springs. Instead, the first resilient member and the second resilient member may be tension coil springs. In the latter case, one end portion of the first resilient member may be connected to the second surface 61*d* of the first cam 61, and another end portion of the first resilient member may be connected to the second flat surface of the second seat member 43*b*. Further, one end portion of the second resilient member may be connected to the fourth surface 62*b* of the second cam 62, and another end portion of the second resilient member may be connected to the fourth flat surface of the fourth seat member 10E.

In the above-described embodiment, the developing roller 30 is in contact with the photosensitive drum 21 when the first cam 61 is at the first position, and the developing roller 30 is separated from the photosensitive drum 21 when the first cam 61 is at the second position. Alternatively, the developing roller 30 may be in contact with the photosensitive drum 21 when the first cam 61 is at the second position, and the developing roller 30 may be separated from the photosensitive drum 21 when the first cam 61 is at the first position. In the latter case, the second inclined surface 61*b* of the first cam and the third inclined surface 62*a* of the second cam 62 may be sloped to approach the casing 10 in the second direction as extending away from the developing roller 30 in the third direction.

Note that the detailed configuration of the developing cartridge 1 may be different from that described above and illustrated in the drawings. Further, each component in the above-described embodiment and modifications may be suitably combined together as long as no technical conflicts is incurred.

What is claimed is:

1. A developing cartridge comprising:

a casing configured to accommodate therein developing agent;

a developing roller rotatable about a developing-roller axis extending in a first direction and contactable with a photosensitive drum, the developing roller having a peripheral surface a portion of which is exposed to an outside of the casing in a second direction, another portion of the peripheral surface opposite the exposed portion in the second direction being positioned inside the casing; and a first cam positioned at an outer surface of one end portion of the casing in the second direction, the first cam being movable in a third direction relative to the casing and the developing roller between a first position and a second position, the second position being closer to the developing roller than the first position is to the developing roller in the third direction, the first cam having:

a first inclined surface configured to receive a pressing force directing from one end portion of the casing in the first direction toward another end portion of the casing in the first direction; and a second inclined surface, a distance in the second direction between the second inclined surface and the casing varying as the second inclined surface extends away from the developing roller in the third direction, wherein the first cam is movable between the first position and the second position in response to application of the pressing force to the first inclined surface.

2. The developing cartridge according to claim 1, wherein, in a state where the developing cartridge is attached to a drum cartridge including the photosensitive drum, the second inclined surface is in contact with a part of the drum cartridge at the first position of the first cam; and the second inclined surface is separated from the part of the drum cartridge at the second position of the first cam.

3. The developing cartridge according to claim 2, wherein the drum cartridge is configured to be accommodated in a main body portion of an image forming apparatus, the main body portion including a drive shaft extending in the first direction and movable in the first direction between an advanced position and a retracted position upon receiving a driving force from the main body portion, the drive shaft being configured to apply the pressing force to the first inclined surface in the first direction from the one end portion of the casing in the first direction toward the another end portion of the casing in the first direction in accordance with movement of the drive shaft in the first direction toward the advanced position, and wherein the first cam moves from the first position to the second position in response to application of the pressing force to the first inclined surface from the drive shaft.

4. The developing cartridge according to claim 2, wherein the first cam moves, relative to the photosensitive drum, in the second direction together with the casing and the developing roller in accordance with movement of the first cam between the first position and the second position.

5. The developing cartridge according to claim 4, wherein the distance between the second inclined surface and the casing in the second direction increases as the second inclined surface extends away from the developing roller in the third direction, wherein the developing roller is in contact with the photosensitive drum at the first position of the first cam, and wherein the developing roller is separated from the photosensitive drum at the second position of the first cam.

6. The developing cartridge according to claim 1, wherein the first inclined surface is inclined with respect to the first direction.

7. The developing cartridge according to claim 1, wherein the second inclined surface is inclined with respect to the second direction and the third direction.

8. The developing cartridge according to claim 1, wherein the second direction crosses the first direction, and wherein the third direction crosses the first direction and the second direction.

9. The developing cartridge according to claim 1, further comprising a first resilient member urging the first cam toward the first position from the second position.

10. The developing cartridge according to claim 9, wherein the developing roller is positioned at one end portion of the casing in the third direction, and wherein the first resilient member urges the first cam toward another end portion of the casing in the third direction from the one end portion of the casing in the third direction.

11. The developing cartridge according to claim 9, wherein the first resilient member is a spring.

12. The developing cartridge according to claim 11, wherein the spring is a coil spring.

13. The developing cartridge according to claim 9, wherein the second inclined surface is inclined to increase the distance in the second direction between the second inclined surface and the casing as extending away from the developing roller in the third direction, and wherein the first resilient member has a first length in the third direction at the first position of the first cam, and wherein the first resilient member has a second length in the third direction smaller than the first length at the second position of the first cam.

14. The developing cartridge according to claim 9, wherein the casing has one end portion and another end portion in the third direction, wherein the first cam has a recess recessed in the third direction toward the another end portion of the casing in the third direction from the one end portion of the casing in the third direction, and wherein the first resilient member has one end in the third direction positioned on a bottom of the recess.

15. The developing cartridge according to claim 1, further comprising a first guide shaft extending in the third direction and positioned at the outer surface of the one end portion of the casing in the second direction, wherein the first cam is movable in the third direction along the first guide shaft.

16. The developing cartridge according to claim 15, wherein the first guide shaft has one end portion and another end portion in the third direction, the one end portion and another end portion of the first guide shaft in the third direction being supported by the casing.

17. The developing cartridge according to claim 15, further comprising a first resilient member which is a coil spring urging the first cam toward the first position from the second position, wherein the first guide shaft is positioned inside the first resilient member.

18. The developing cartridge according to claim 15, wherein the first guide shaft extends throughout the first cam in the third direction.

19. The developing cartridge according to claim 1, wherein the first cam is spaced away from the developing roller in the third direction by a first distance at the first position of the first cam, and wherein the first cam is spaced away from the developing roller in the third direction by a second distance shorter than the first distance at the second position of the first cam.

20. The developing cartridge according to claim 1, wherein the first cam is positioned at an outer surface at the one end portion of the casing in the first direction.

21. The developing cartridge according to claim 1, further comprising a handle configured to be gripped by a user, the handle being positioned at an outer surface of another end portion of the casing in the third direction.

22. The developing cartridge according to claim 1, further comprising a second cam positioned at the outer surface of the one end portion of the casing in the second direction, the second cam being movable in the third direction relative to the casing and the developing roller between a third position and a fourth position, the fourth position being closer to the developing roller in the third direction than the third position is to the developing roller in the third direction, wherein the second cam has a third inclined surface, a distance in the second direction between the third inclined surface and the casing varying as the third inclined surface extends away from the developing roller in the third direction.

23. The developing cartridge according to claim 22, wherein the first cam is positioned at an outer surface of the one end portion of the casing in the first direction, and wherein the second cam is positioned at an outer surface of the another end portion of the casing in the first direction.

24. The developing cartridge according to claim 22, wherein the second cam moves from the third position to the fourth position in accordance with movement of the first cam from the first position to the second position.

25. The developing cartridge according to claim 22, wherein, in a state where the developing cartridge is attached to a drum cartridge including the photosensitive drum, the second inclined surface is in contact with a part of the drum cartridge at the first position of the first cam, the second inclined surface is separated from the part of the drum cartridge at the second position of the first cam, the third inclined surface is in contact with another part of the drum cartridge at the third position of the second cam; and the third inclined surface is separated from the another part of the drum cartridge at the fourth position of the second cam.

26. The developing cartridge according to claim 22, wherein the second cam is movable together with the casing and the developing roller in the second direction relative to the photosensitive drum in accordance with the movement of the second cam between the third position and the fourth position.

27. The developing cartridge according to claim 22, wherein the second inclined surface is inclined to increase the distance between the second inclined surface and the casing in the second direction as extending away from the developing roller in the third direction, and wherein the third inclined surface is inclined to increase the distance between the third inclined surface and the casing in the second direction as extending away the developing roller in the third direction.

28. The developing cartridge according to claim 27, wherein the developing roller is in contact with the photosensitive drum at the third position of the second cam, and wherein the developing roller is separated from the photosensitive drum at the fourth position of the second cam.

29. The developing cartridge according to claim 22, wherein the third inclined surface is inclined with respect to the second direction and the third direction.

30. The developing cartridge according to claim 22, further comprising a connection bar extending in the first direction and positioned between the first cam and the second cam in the first direction to connect the first cam to the second cam.

31. The developing cartridge according to claim 30, wherein the first cam is fixed to one end portion of the connection bar in the first direction, and wherein the second cam is fixed to another end portion of the connection bar in the first direction.

* * * * *